US009353969B2

(12) United States Patent
Luo

(10) Patent No.: US 9,353,969 B2
(45) Date of Patent: May 31, 2016

(54) WATER TANK AND HEAT PUMP WATER HEATER COMPRISING THE SAME

(71) Applicants: GD MIDEA HEATING & VENTILATING EQUIPMENT CO., LTD., Beijiao (CN); MIDEA GROUP CO., LTD., Beijiao (CN)

(72) Inventor: Mingwen Luo, Beijiao (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 118 days.

(21) Appl. No.: 14/315,369

(22) Filed: Jun. 26, 2014

(65) Prior Publication Data

US 2015/0000324 A1 Jan. 1, 2015

(30) Foreign Application Priority Data

Jun. 26, 2013 (CN) ..... 2013 2 0374262 U
Jun. 16, 2014 (CN) ..... 2014 2 0321198 U

(51) Int. Cl.
*F24H 4/04* (2006.01)

(52) U.S. Cl.
CPC ..... *F24H 4/04* (2013.01)

(58) Field of Classification Search
CPC ..... F24H 4/04; F24H 4/02
USPC ..... 62/324.3
See application file for complete search history.

(56) References Cited

U.S. PATENT DOCUMENTS

| | | | | |
|---|---|---|---|---|
| 4,308,912 | A * | 1/1982 | Knecht | C08F 257/02 126/585 |
| 4,452,050 | A * | 6/1984 | Pierce | F24H 4/04 165/169 |
| 4,918,938 | A * | 4/1990 | De Forest | F24H 4/04 126/642 |
| 2006/0011149 | A1* | 1/2006 | Stevens | F24H 1/18 122/19.2 |
| 2009/0173102 | A1* | 7/2009 | Ogasawara | F25B 39/04 62/498 |
| 2012/0060521 | A1* | 3/2012 | Roetker | F24H 4/04 62/79 |
| 2012/0060535 | A1* | 3/2012 | Crosby | F24H 4/04 62/238.7 |
| 2013/0031923 | A1* | 2/2013 | DuPlessis | F28D 1/06 62/238.1 |
| 2014/0124051 | A1* | 5/2014 | Bewley, Jr. | F24H 4/04 137/334 |
| 2014/0260392 | A1* | 9/2014 | Hawkins | F25B 5/04 62/238.6 |
| 2014/0283540 | A1* | 9/2014 | Leman | F24H 4/04 62/238.6 |

* cited by examiner

*Primary Examiner* — Daniel Rohrhoff
(74) *Attorney, Agent, or Firm* — Hodgson Russ LLP

(57) ABSTRACT

A water tank may include an inner tank and a condenser. The condenser may have a liquid inlet tube, a liquid outlet tube, first and second condensing tubes wound around respectively an outer wall of an upper and lower part of the inner tank, first ends of the first and second condensing tubes being in fluid communication with the second end of the liquid inlet tube, and a third condensing tube wound around an outer wall of a bottom part of the inner tank beneath the lower part. A first end of the third condensing tube may be in fluid communication with second ends of the first and second condensing tubes respectively. A second end of the third condensing tube may be in fluid communication with a first end of the liquid outlet tube. A heat pump water heater comprising the water tank may be further provided.

17 Claims, 5 Drawing Sheets

WATER TANK AND HEAT PUMP WATER HEATER COMPRISING THE SAME

CROSS REFERENCE TO RELATED APPLICATIONS

This application claims priority to Chinese Patent Application No. 201320374262.5, filed with State Intellectual Property Office of the People's Republic of China on Jun. 26, 2013, and to Chinese Patent Application No. 201420321198.9 filed with State Intellectual Property Office of the People's Republic of China on Jun. 16, 2014, the entire disclosures of which are incorporated herein by reference.

FIELD

Embodiments of the present disclosure generally relate to the field of water heating, more particularly, to a water tank and a heat pump water heater.

BACKGROUND

Conventionally, a plurality of winding manners, such as follows, for winding heating tube around a water tank may be adopted:

1. A single condensing tube may be wound around the outer wall of the water tank downwardly;
2. A single condensing tube may be wound around the outer wall of the water tank upwardly;
3. At least two condensing tubes may be wound around the outer wall of the water tank downwardly; and
4. At least two condensing tubes are wound around the outer wall of the water tank upwardly.

When the first and third winding manners may be used, because the refrigerant and water with high temperature are both inside the upper part of the water tank, the temperature of water inside of the upper part may be higher than that inside the lower part of the water tank, thus the heating efficiency may be lowered. Further, with the first winding manner, a single long condensing tube may result in high pressure drop of the refrigerant.

When the second and fourth winding manners may be used, the vapor lock phenomenon of the refrigerant may appear. To be specific, after the water in the water tank may be heated, the water temperature inside the upper part may be higher than that inside of the lower part of the water tank, when cold water may flow therein. Thus, the refrigerant in the condensing tubes wound around the upper part of the water tank may be transformed into gaseous state with high temperature and pressure, after heat transferring with the water with high temperature. And the refrigerant in the condensing tubes wound around the lower part of the water tank may be transformed into liquid state with low temperature and pressure after heat exchanging with the water with low temperature.

In this case, if the pressure differences and flow resistance cannot be overcome by the refrigerant, the refrigerant may not be circulated, and at this time, the suction pressure of the compressor may be very low, resulting higher ratio of high/low pressure of the compressor, even beyond the allowable working range thereof, thus influencing the working life of the compressor and the heat pump water heater accordingly. Meanwhile, since the refrigerant in the condensing tubes may not be circulated or may hardly be circulated, the heating efficiency of the heat pump system may be very low. And at the same time, the compressor may be running in a power-consuming mode whereas the water temperature of the water in the water tank may rise very slowly, thus leading to a deteriorated heating efficiency.

In addition, two temperature sensors are used in a water tank conventionally, one of which is disposed at the upper part of the water tank, and the other one at the lower part of the water tank. Therefore, the lower temperature sensor may detect the temperature drop of the water in the water tank more immediately, when the cold water was injected into the water tank. While the upper temperature sensor is used to control the heating of the water heater, or show the temperature of the usable water. In this case, if only one temperature is used and disposed at the lower part of the water tank, the water temperature detected may be dropped immediately when little cold water was injected into the water tank. Consequently, the actual water temperature may be not shown to the user. Further, the water temperature at the upper part of the water tank is unknown when stopping heating because of the single lower temperature sensor, so that the time of stopping heating of the water heater may be uncontrollable, thus possibly making the water temperature at which the heater is shut down higher than the predetermined temperature. On the other hand, if only one temperature sensor is disposed at the upper part of the water tank, the temperature may be detected only when the cold water is injected enough up to the height of the temperature sensor. Consequently, the time of starting the heater may be later than a predetermined time, and the user have to wait a longer time to use the hot water again.

SUMMARY

Embodiment of the present disclosure may provide a water tank, including: an inner tank; and a condenser disposed on the inner tank for heating water contained therein. The condenser may comprise a liquid inlet tube defining a first end and a second end, a liquid outlet tube defining a first end and a second end, a first condensing tube wound around an outer wall of an upper part of the inner tank, a second condensing tube wound around an outer wall of the lower part of the inner tank and a third condensing tube wound around an outer wall of a bottom part of the inner tank beneath the lower part. A first end of the first condensing tube may be communicated with the second end of the liquid inlet tube. A first end of the second condensing tube may be communicated with the second end of the liquid inlet tube. A first end of the third condensing tube may be communicated with second ends of the first and second condensing tubes respectively, and a second end of the third condensing tube may be communicated with a first end of the liquid outlet tube.

Embodiment of the present disclosure may further provide a heat pump water heater, which may comprise a water tank; a compressor, an outlet of which may be communicated with the first end of the liquid inlet tube; a throttling device, an inlet of which may be communicated with the second end of the liquid outlet tube; an evaporator, an inlet of which may be communicated with the outlet of the throttling device, and an outlet of which may be communicated with the inlet of the compressor. The water tank may comprise an inner tank, and a condenser disposed on the inner tank for heating water contained therein. The condenser may have a liquid inlet tube defining a first end and a second end, a liquid outlet tube defining a first end and a second end, a first condensing tube wound around an outer wall of an upper part of the inner tank, a second condensing tube wound around an outer wall of the lower part of the inner tank, and a third condensing tube wound around an outer wall of a bottom part of the inner tank beneath the lower part. A first end of the first condensing tube may be communicated with the second end of the liquid inlet tube; a first end of the second condensing tube may be communicated with the second end of the liquid inlet tube. A first end of the third condensing tube may be communicated with second ends of the first and second condensing tubes respectively, and a second end of the third condensing tube may be communicated with a first end of the liquid outlet tube.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference the accompanying drawings, in which.

DETAILED DESCRIPTION

Figure 1:
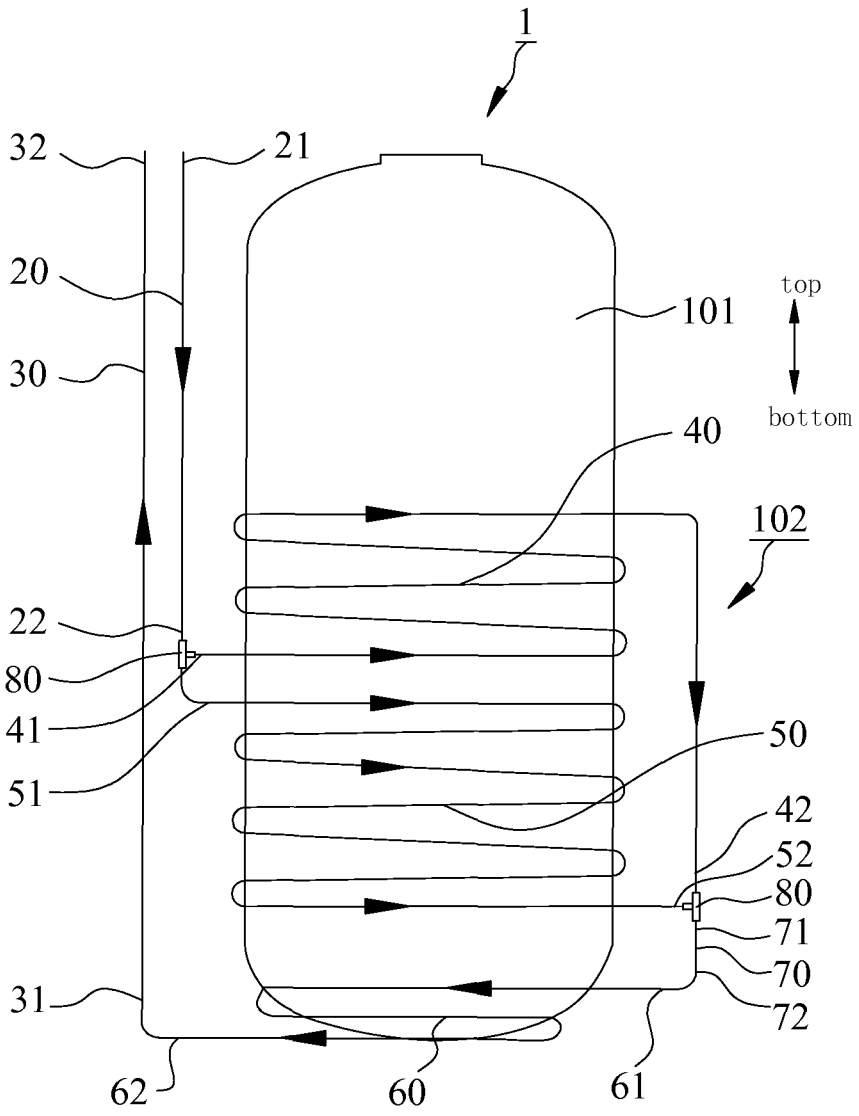
FIG. 1 is a schematic view of a water tank according to an embodiment of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, Unless specified or limited otherwise, relative terms such as "inner", "outer", "lower", "upper", "horizontal", "vertical", "above", "below", "up", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation.

Terms concerning attachments, coupling and the like, such as "connected" and "interconnected", refer to a relationship wherein structures are secured or attached to one another either directly or indirectly through intervening structures, as well as both movable or rigid attachments or relationships, unless expressly described otherwise. In addition, terms such as "first" and "second" are used herein for purposes of description and are not intended to indicate or imply relative importance or significance.

In the following, a water tank according to embodiments of the present disclosure will be described herein below in detail with reference to FIGS. 1-6.

Figure 2:
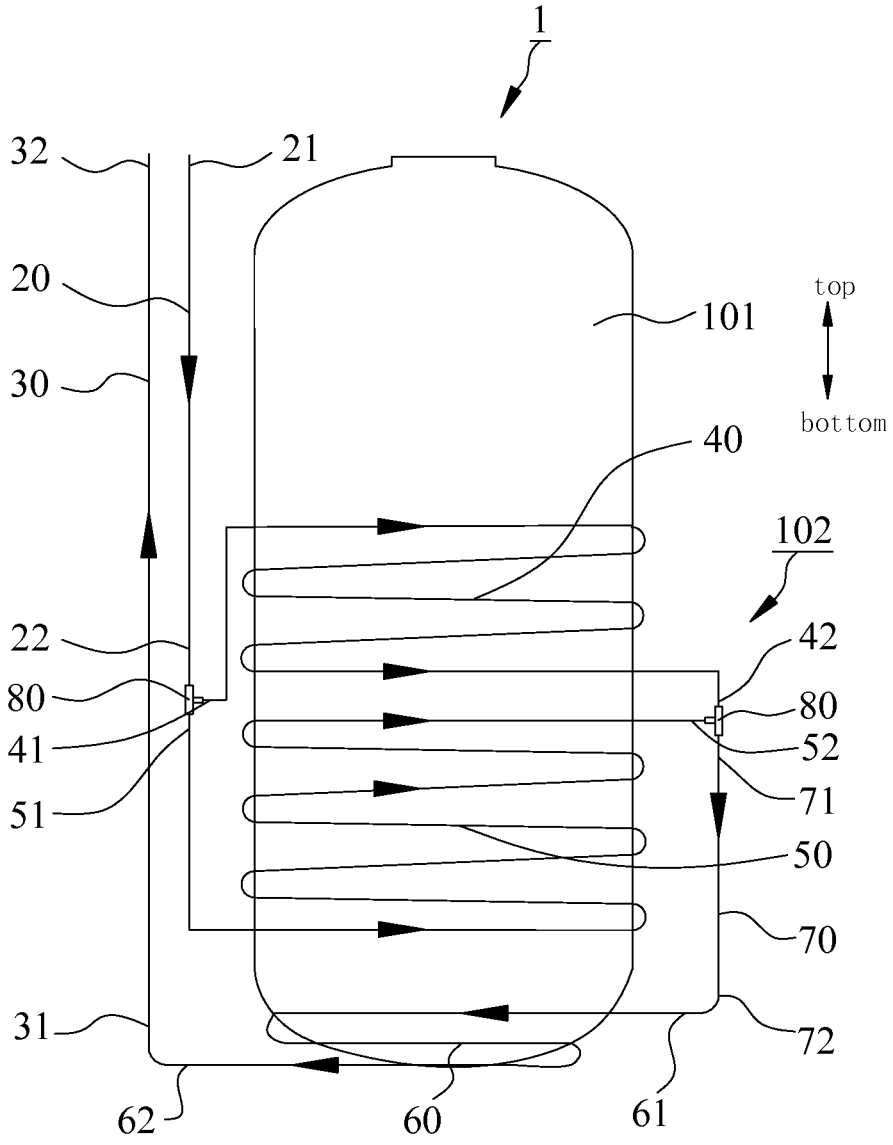
FIG. 2 is a schematic view of the water tank according to another embodiment of the present disclosure.

As shown in FIGS. 1 and 2, the water tank 1 according to an embodiment of the present disclosure may include an inner tank 101 and a condenser 102 disposed on the inner tank 101 for heating water contained in the inner tank 101. The condenser 102 may include a liquid inlet tube 20, a liquid outlet tube 30, a first condensing tube 40, a second condensing 50, and a third condensing tube 60.

The liquid inlet tube 20 may define a first end 21 and a second end 22, and the liquid outlet tube 30 may define a first end 31 and a second end 32. The first end 21 of the liquid inlet tube 20 may be configured as an inlet through which the refrigerant may flow into the condenser 102. The second end 32 of the liquid outlet tube 30 may be configured as an outlet through which the refrigerant may flow outside the condenser 102.

In one embodiment, the second end 22 of the liquid inlet tube 20 may be communicated with the first end 31 of the liquid outlet tube 30. More specifically, the second end 22 of the liquid inlet tube 20 and the first end 31 of the liquid outlet tube 30 may be communicated with each other via the first condensing tube 40, the second condensing 50, and the third condensing tube 60.

In one embodiment, the first condensing tube 40 may be wound around an outer wall of an upper part of the inner tank 101, and the first end 41 of the first condensing tube 40 may be communicated with the second end 22 of the liquid inlet tube 20. The second condensing tube 50 may be wound around an outer wall of the lower part of the inner tank 101, and the first end 51 of the second condensing tube 50 may be communicated with the second end 22 of the liquid inlet tube 20. The third condensing tube 60 may be wound around an outer wall of the bottom part of the inner tank 101 beneath the lower part, the first end 61 of the third condensing tube 60 may be communicated with second ends of the first and second condensing tubes 50, 60 respectively, the second end 62 of the third condensing tube 60 may be communicated with the first end 31 of the liquid outlet tube 30. That is, the first condensing tube 40 and the second condensing tube 50 may be connected in parallel, and then connected in series with the third condensing tube 60 between the liquid inlet tube 20 and the liquid outlet tube 30.

As stated herein, it is understandable that, the second end 22 of the liquid inlet tube 20 may be positioned substantially at the middle part of the inner tank 101. The term "upper part" of the inner tank 101 described herein may be the part of the inner tank 101 above the second end 22 of the liquid inlet tube 20, the term "lower part" of the inner tank 101 may be the part of the inner tank 101 below the second end 22 of the liquid inlet tube 20, and the term "bottom part" of the inner tank 101 may be the part of the inner tank 101 substantially at the bottom of the inner tank 101.

That is to say, on the inner tank 101, the second condensing tube 50 may be below the first condensing tube 40, and the third condensing tube 60 may be below or beneath the second condensing tube 50.

The flow path of the refrigerant in each tube of the condenser 102 of the water tank according to an embodiment of the present disclosure will be described in detail with reference to FIGS. 1-2 in the following.

Firstly, the refrigerant may flow into the condenser 102 via the first end 21 of the liquid inlet tube 20, and divide into two paths. The refrigerant of the first path may flow into the first condensing tube 40 on the upper part of the inner tank 101 via the first end 41 thereof, exchange heat with the water in the interior of the inner tank 101, and then flow to the second end 42 of the first condensing tube 40. The refrigerant of the second path may flow into the second condensing tube 50 on the lower part of the inner tank 101 via the first end 51 thereof, exchange heat with the water in the inner tank 101, and then flow to the second end 52 of the second condensing tube 50 accordingly.

Finally, the refrigerant in the first and second paths may join at the first end 61 of the third condensing tube 60, and flow into the third condensing tube 60 at the bottom part of the inner tank 101, exchange heat with the water in the inner tank 101, flow to the second end 62 of the third condensing tube 60, and then discharge out of the condenser 102 via the liquid outlet tube 30.

With the water tank according to embodiments of the present disclosure, because of the first to third condensing tubes wound around the inner tank 101, the water in the upper and lower parts of the inner tank 101 may be heated simultaneously by the refrigerant with high temperature, thus avoiding a dramatic temperature difference between the water in the upper and lower parts of the inner tank 101, thus enhancing the heating efficiency. Further, the water tank 1 may have a simplified structure. In addition, due to the above configured condensing tubes of the condenser 102, the defected dramatic pressure drop for the refrigerant in prior single condensing tube may be overcome accordingly.

Furthermore, the water in the upper and lower parts of the inner tank 101 may firstly be heated, followed by the water in the bottom part being heated, the refrigerant may flow substantially downwardly, thus avoiding the vapor lock phenomenon with the energy consumption being lowered.

The way for connecting the first condensing tube 40, the second condensing tube 50, and the third condensing tube 60 may not be specially limited, so long as the connection of first condensing tube 40, the second condensing tube 50, and the third condensing tube 60 may be connected in communication. In an alternative embodiment, as shown in FIGS. 1 and 2, the first condensing tube 40, the second condensing tube 50, and the third condensing tube 60 may be communicated via a T-junction 80. In other words, the first end 41 of the first condensing tube 40, the first end 51 of the second condensing 50, and the second end 22 of the liquid inlet tube 20 may be communicated via a T-junction 80. Therefore, the structure of the water tank 1 may be simplified, and the installation may be convenient with the cost being reduced.

In one embodiment, as shown in FIGS. 1 and 2, the water tank 1 may further include a fourth condensing tube 70. The fourth condensing tube 70 may be disposed outside of the inner tank 101 and extended along a vertical direction of the water tank 1. The first end of the fourth condensing tube 70 may be communicated with the second ends 52,52 of the first condensing tube 40 and the second condensing tube 50 respectively, the second end of the fourth condensing tube 70 may be communicated with the first end 61 of the third condensing tube 60. In another embodiment, the liquid inlet tube 20 and the liquid outlet tube 30 may be disposed at the same side, i.e., the left side in FIGS. 1 and 2, of the inner tank 101, the fourth condensing tube 70 may be disposed at the other side, i.e., the right side in FIGS. 1 and 2, of the inner tank 101 opposite to the liquid inlet tube 20 and the liquid outlet tube 30. Therefore, with the fourth condensing tube 70, it may be convenient to connect the first condensing tube 40, the second condensing 50, and the third condensing tube 60 accordingly. In addition, because the fourth condensing tube 70 is disposed opposite to the liquid inlet tube 20 and the liquid outlet tube 30, there may be no interference among the tubes 70, 20, and 30, thus simplifying assembly.

In a corresponding manner, the way of connecting the fourth condensing tube 70, the first condensing tube 40 and the second condensing tube 50 may not be specially limited. The similar way to that for connecting the first condensing tube 40, the second condensing tube 50, and the third condensing tube 60 may be adopted herein. That is, the fourth condensing tube 70 may be connected with the first condensing tube 40 and the second condensing tube 50 via a T-junction 80. The concrete connecting manner of the fourth condensing tube 70, the first condensing tube 40 and the second condensing tube 50, may be similar to that of the first condensing tube 40, the second condensing tube 50, and the third condensing tube 60, which are not described in detail herein.

In one embodiment, the refrigerant from the second end 42 of the first condensing tube 40 and the second end 52 of the second condensing tube 50 may converge, and then flow to the third condensing tube 60 through the fourth condensing tube 70. In one embodiment, the refrigerant may flow to the fourth condensing tube 70 via the first end 71 thereof, through the second end 72 thereof, and finally to the first end 61 of the third condensing tube 60.

In one embodiment, as shown in FIG. 1, the first condensing tube 40 may be wound upwardly around the inner tank 101 from the second end of the liquid inlet tube 20. The first end 41 of the first condensing tube 40 may be higher/lower than, or equal to the height of the second end 42 of the first condensing tube 40. Correspondingly, the second condensing tube 50 may be wound downwardly around the inner tank 101 from the second end of the liquid inlet tube 20. The first end 51 of the second condensing tube 50 may be higher/lower than, or equal to the height of the second end 52 of the second condensing tube 50. In one embodiment, as shown in FIG. 1, the second end 42 of the first condensing tube 40 may be extended downwardly to be connected with the second end 52 of the second condensing tube 50, and then connected with the first end 71 of the fourth condensing tube 70.

In another embodiment, as shown in FIG. 2, the first condensing tube 40 may be wound downwardly around the inner tank 101 from the second end of the liquid inlet tube 20. The first end 41 of the first condensing tube 40 may be higher/lower than, or equal to the height of the second end 42 of the first condensing tube 40. Correspondingly, the second condensing tube 50 may be wound upwardly around the inner tank 101 from the second end of the liquid inlet tube 20. In one embodiment, as shown in FIG. 2, the first end 41 of the first condensing tube 40 may be firstly extended upwardly from the second end 22 of the liquid inlet tube 20 to the topmost position of the first condensing tube 40 on the inner tank 101, and then wound downwardly around the inner tank 101. The first end 51 of the second condensing tube 50 may be firstly extended downwardly from the second end of the liquid inlet tube 20 to the lowest position of the second condensing tube 50 on the inner tank 101, and then wound upwardly around the inner tank 101. After that, the second end 42 of the first condensing tube 40 and the second end 52 of the second condensing tube 50 may be joined together, and connected with the first end 71 of the fourth condensing tube 70.

In other words, in the above mentioned embodiments, the winding directions of the first condensing tube 40 and the second condensing tube 50 around the inner tank 101 from the second end of the liquid inlet tube 20 may be opposite, so that even heating for the water in the inner tank 101 may be ensured, thus avoiding dramatic temperature difference between the water in the upper and lower part of the inner tank 101 respectively. In addition, the vapor lock phenomenon in a conventional water heater may be avoided. Therefore the heating efficiency of the water heater having the water tank described above may be further enhanced, and the working life thereof may be increased accordingly.

In the following, a heat pump water heater according to embodiments of the present disclosure will be described herein below in detail with reference to FIGS. 3-6.

The heat pump water heater according to an embodiment of the present disclosure may include: a water tank 1 described above, a compressor 2, a throttling device 3, and an evaporator 4. In one embodiment, the water tank 1 includes: an inner tank 101 and a condenser 102 disposed on the inner tank 101 for heating water contained therein. The condenser 102 may include: a liquid inlet tube 20, a liquid outlet tube 30, a first condensing tube 40, a second condensing 50, and a third condensing tube 60.

The liquid inlet tube 20 may define a first end 21 and a second end 22, and the liquid outlet tube 30 may define a first end 31 and a second end 32. The first end 21 of the liquid inlet tube 20 may be configured as an inlet through which the refrigerant flows into the condenser 102. The second end 32 of the liquid outlet tube 30 may be configured as an outlet through which the refrigerant flows outside the condenser 102.

In one embodiment, the second end 22 of the liquid inlet tube 20 may be communicated with the first end 31 of the liquid outlet tube 30. More specifically, the second end 22 of the liquid inlet tube 20 and the first end 31 of the liquid outlet tube 30 may be communicated with each other via the first condensing tube 40, the second condensing 50, and the third condensing tube 60.

In one embodiment, the first condensing tube 40 may be wound around an outer wall of an upper part of the inner tank 101, and the first end 41 of the first condensing tube 40 may be communicated with the second end 22 of the liquid inlet tube 20. The second condensing tube 50 may be wound around an outer wall of the lower part of the inner tank 101, and the first end 51 of the second condensing tube 50 may be communicated with the second end 22 of the liquid inlet tube 20. The third condensing tube 60 may be wound around an outer wall of the bottom part of the inner tank 101 beneath the lower part, the first end 61 of the third condensing tube 60 may be communicated with second ends of the first and second condensing tubes 50, 60 respectively, the second end 62 of the third condensing tube 60 may be communicated with the first end 31 of the liquid outlet tube 30. That is, the first condensing tube 40 and the second condensing tube 50 may be disposed in parallel connection, thus connected in series with the third condensing tube 60 between the liquid inlet tube 20 and the liquid outlet tube 30.

Figure 6:
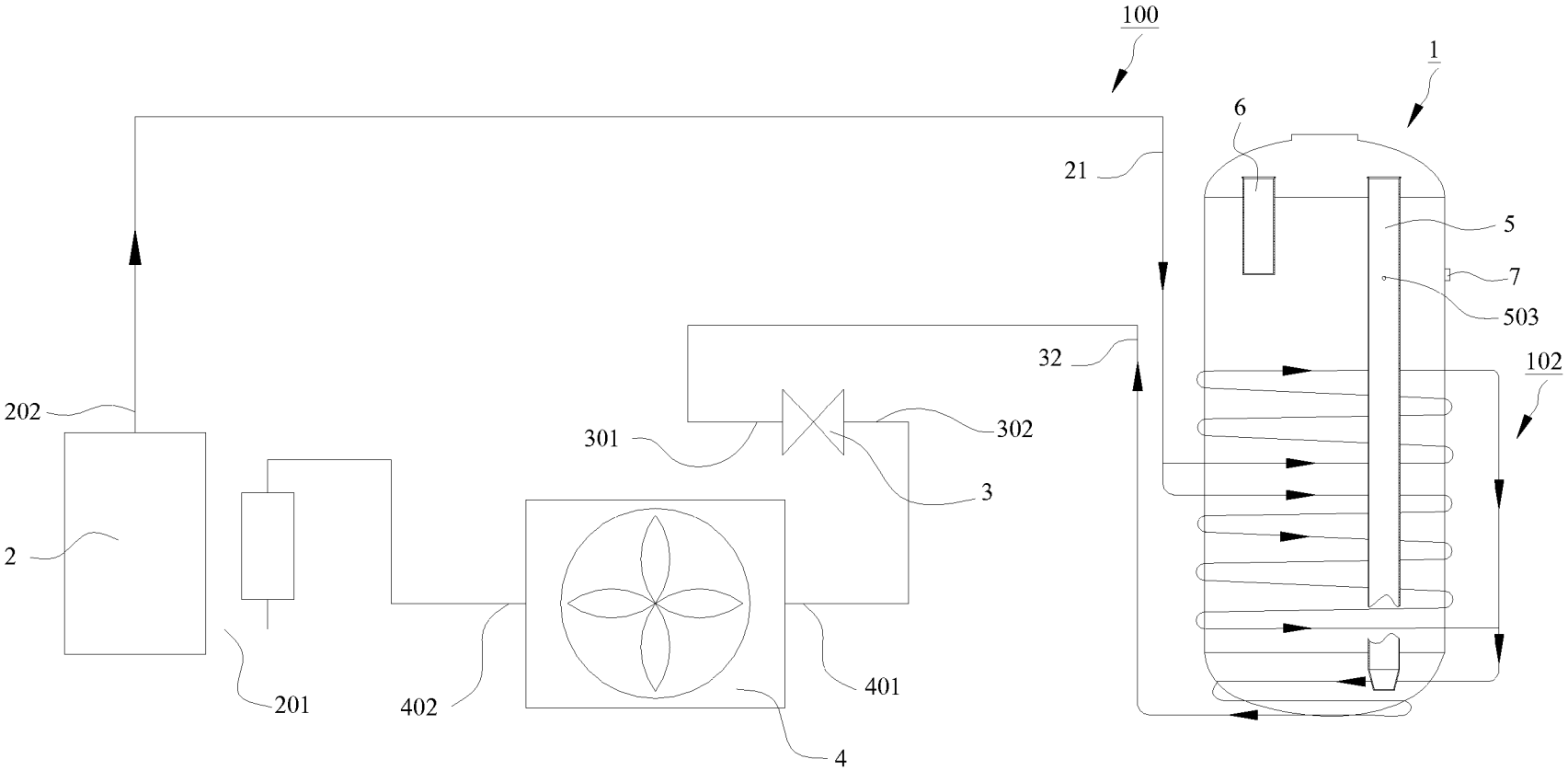
FIG. 6 is a schematic view of a heat pump water heater according to an embodiment of the present disclosure.

As shown in FIG. 6, the outlet 202 of the compressor 2 may be connected with the first end 21 of the liquid inlet tube 20, an inlet 301 of the throttling device 3 may be connected with the second end 32 of the liquid outlet tube 30, an inlet 401 of the evaporator 4 may be connected with the outlet 302 of the throttling device 3, and an outlet 402 of the evaporator 4 may be connected with the inlet 201 of the compressor 2. That is, the compressor 2, the condenser 102, the throttling device 3, and the evaporator 4 may be connected in series successively.

The heat pump water heater according to embodiments of the present disclosure may have advantages that are similar to the advantage of the water tank described in above embodiments. That is, with the heat pump water heater according to embodiments of the present disclosure, the vapor lock phenomenon in a conventional water heater may be avoided, and the working life of the heat pump water heater may be increased. In addition, the heating efficiency may be further enhanced.

In some embodiments, as shown in FIGS. 3-6, the inner tank 101 may be provided with a cold water inlet tube 5. The first end 501 of the cold water inlet tube 5 may be adapted to be communicated with water source outside, and the second end 502 thereof may be extended downwardly into the inner tank 101 until close to the bottom of the inner tank 101. The cold water inlet tube 5 may be used to supply water into the inner tank 101. Because the second end 502 of the cold water inlet tube 5 is close to the bottom of the inner tank 101, the cold water may be injected toward the bottom of the inner tank 101. In this way, as the density of hot water is lower than that of cold water, the hot water in the upper part of the inner tank 101 will not be mixed with cold water introduced, thus enhancing the effect of heat preservation and saving energy.

In another embodiment, the inner tank 101 may be provided with a hot water outlet tube 6, to discharge hot water in the inner tank 101 to an end user. As shown in FIGS. 3-6, the hot water outlet tube 6 may be provided at the upper part of the inner tank 101.

In some embodiments, as shown in FIGS. 3-6, the inner tank 101 may further be provided with a temperature sensor 7 for detecting the water temperature in the inner tank 101. And the temperature sensor 7 may be communicated with a main control system (not shown) of the heat pump water heater for power operation, such as shutdown or startup etc.

Figure 3:
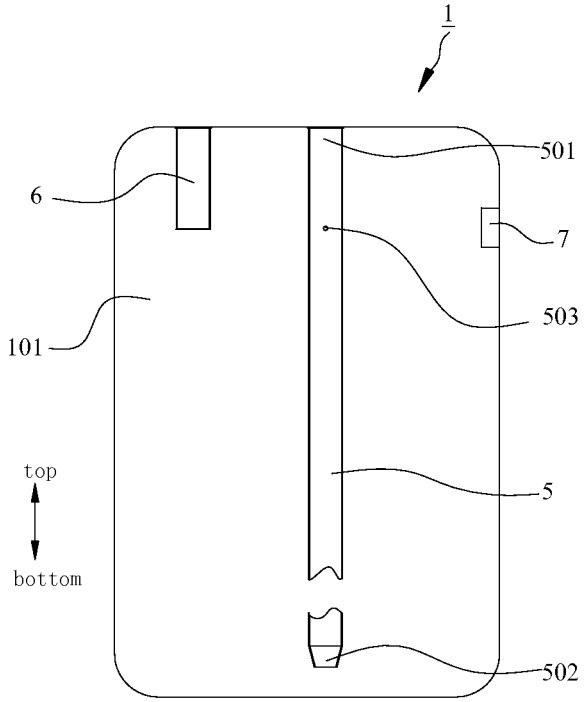
FIG. 3 is a schematic view of the water tank according to an embodiment of the present disclosure showing a configuration of a cold water inlet tube, a temperature sensor and through apertures formed on the cold water inlet tube.
Figure 4:
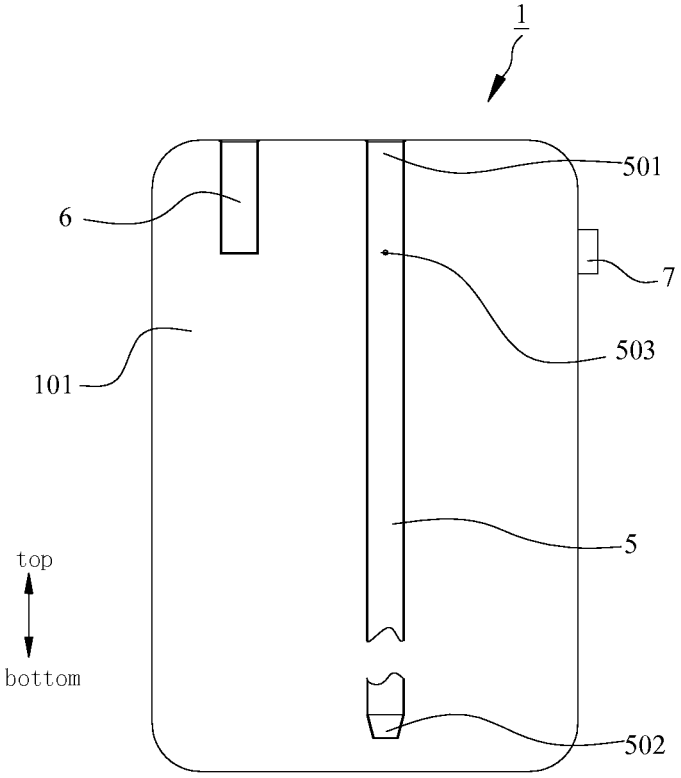
FIG. 4 is a schematic view of the water tank according to another embodiment of the present disclosure, showing a configuration of a cold water inlet tube, a temperature sensor and through apertures formed on the cold water inlet tube.

In one embodiment, as shown in FIG. 3, the temperature sensor 7 may be disposed at an inner wall of the inner tank 101, so that the detection of the temperature sensor 7 to the temperature of water inside of the inner tank 101 may be more accurate and timely. In another embodiment, as shown in FIG. 4, the temperature sensor 7 may be disposed on an outer wall of the inner tank 101, thus avoiding damage to the temperature sensor 7 caused by direct exposure to rapid hot/cold water heat exchange, and consequently increasing the working life of the temperature sensor 7.

Figure 5:
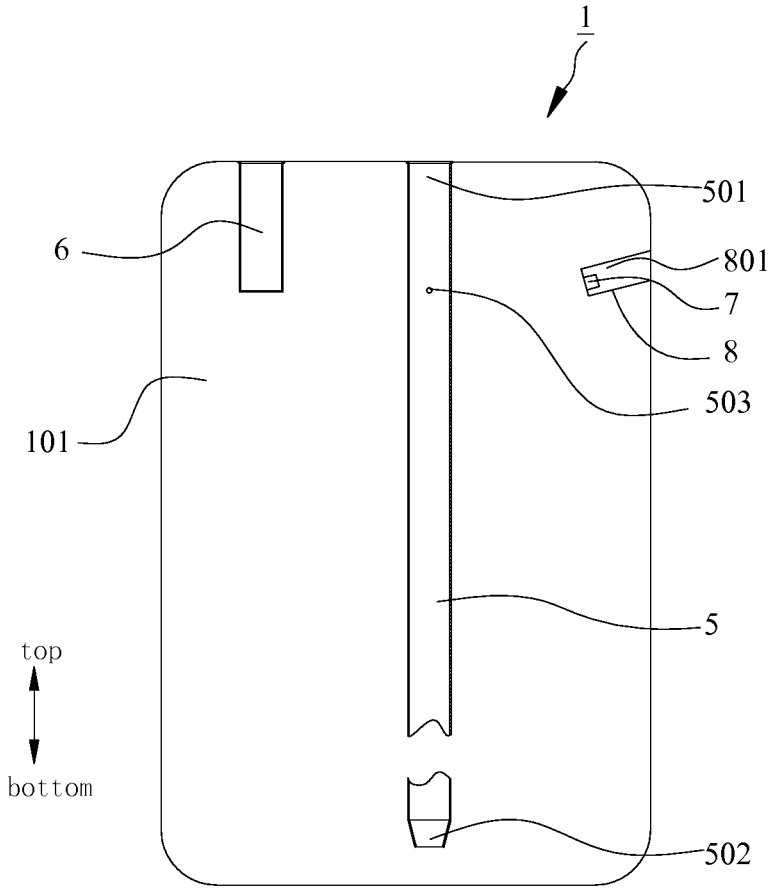
FIG. 5 is a schematic view of the water tank according to still another embodiment of the present disclosure, showing a configuration of a cold water inlet tube, a temperature sensor and through apertures formed on the cold water inlet tube.

In yet another embodiment, as shown in FIG. 5, the heat pump water heater may further include a blind tube 8. The blind tube 8 may be disposed at the outer wall of the inner tank 101 and extended into the inner tank 101. The temperature sensor 7 may be disposed inside the blind tube 8. As described herein, the term "blind tube" is a kind of a tube with a sealed end forming a chamber 801, as shown in FIG. 5. The open end of the blind tube 8 may be disposed on the outer wall of the inner tank 101, and the sealed end of the blind tube 8 may be projected into the inner tank 101. However, the chamber 801 of the blind tube 8 is not communicated with the inner tank 101, and the temperature sensor 7 may be disposed in the chamber 801. Therefore, the temperature sensor 7 may be in close contact with the water in the inner tank 101 at the sealed end of the blind tube 8, thus avoiding damages caused by direct exposure of the temperature sensor 7 to water in the inner tank 101.

In some embodiments, as shown in FIGS. 3-6, a plurality of through apertures 503 may be formed on a part of the cold water inlet tube 5 inside the water tank 1, with the through apertures 503 being configured substantially toward the temperature sensor 7. Because of the through apertures 503, a part of the cold water from the cold water inlet tube 5 may be sprayed out of the cold water inlet tube 5 and mixed with the water inside of the inner tank 101, so that the temperature of the water near the through apertures 503 may be reduced to some extent. In an alternative embodiment, the through apertures 503 may be disposed at substantially the same level with the temperature sensor 7. Therefore, the temperature sensor 7 may detect the reduction of the water temperature nearby, and communicate the condition of the water temperature being lowered to the main control system (not shown). And then, the heat pump water heater, particularly the compressor 2, may be controlled to start by the main control system. In another embodiment, the through apertures 503 may be disposed at a different level with the temperature sensor 7, if only the temperature sensor 7 can detect the temperature of the water sprayed from the through apertures 503.

Advantageously, the through apertures 503 may be disposed over the first condensing tube 40. That is to say, the vertical heights of the through apertures 503 may be higher than that of the first condensing tube 40, because the hot water is generally concentrated at the top part of the inner tank 101. Thus, the cold water sprayed through the through apertures 503 may be mixed with the hot water in the upper part of the inner tank 101. Therefore, the detection of the temperature sensor 7 may be more accurate. Correspondingly, the temperature sensor 7 may be disposed over the first condensing tube 40.

Reference throughout this specification to "an embodiment," "some embodiments," "one embodiment", "another example," "an example," "a specific examples," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example, "in an example," "in a specific examples," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A water tank, comprising:
an inner tank; and
a condenser disposed on the inner tank for heating water contained therein, having:
a liquid inlet tube defining a first end and a second end;
a liquid outlet tube defining a first end and a second end;
a first condensing tube wound around an outer wall of an upper part of the inner tank, a first end of the first condensing tube being communicated with the second end of the liquid inlet tube;
a second condensing tube wound around an outer wall of the lower part of the inner tank, a first end of the second condensing tube being communicated with the second end of the liquid inlet tube; and
a third condensing tube wound around an outer wall of a bottom part of the inner tank beneath the lower part, a first end of the third condensing tube being communicated with second ends of the first and second condensing tubes respectively, a second end of the third condensing tube being communicated with a first end of the liquid outlet tube;
wherein the first condensing tube, the second condensing tube, and the third condensing tube are communicated via a T-junction.

2. The water tank of claim 1, further comprising:
a fourth condensing tube disposed outside of the inner tank and extended along a vertical direction of the water tank, wherein
a first end of the fourth condensing tube is communicated with second ends of the first condensing tube and the second condensing tube respectively, a second end of the fourth condensing tube is communicated with the first end of the third condensing tube.

3. The water tank of claim 2, wherein the liquid inlet tube and the liquid outlet tube are disposed at the same side of the inner tank, the fourth condensing tube is disposed at the other side of the inner tank opposite to the liquid inlet tube and the liquid outlet tube.

4. The water tank of claim 2, wherein the fourth condensing tube is communicated with the first condensing tube and the second condensing tube via a T-junction.

5. The water tank of claim 1, wherein the first condensing tube is wound upwardly around the inner tank from the second end of the liquid inlet tube.

6. The water tank of claim 1, wherein the second condensing tube is wound downwardly around the inner tank from the second end of the liquid inlet tube.

7. The water tank of claim 1, wherein the first condensing tube is wound downwardly around the inner tank from the second end of the liquid inlet tube.

8. The water tank of claim 1, wherein the second condensing tube is wound upwardly around the inner tank from the second end of the liquid inlet tube.

9. A heat pump water heater, comprising:
a water tank comprising:
an inner tank; and
a condenser disposed on the inner tank for heating water contained therein, having:
a liquid inlet tube defining a first end and a second end;
a liquid outlet tube defining a first end and a second end;
a first condensing tube wound around an outer wall of an upper part of the inner tank, a first end of is the first condensing tube being communicated with the second end of the liquid inlet tube;
a second condensing tube wound around an outer wall of the lower part of the inner tank, a first end of is the second condensing tube being communicated with the second end of the liquid inlet tube; and
a third condensing tube wound around an outer wall of a bottom part of the inner tank beneath the lower part, a first end of the third condensing tube being communicated with second ends of the first and second condensing tubes respectively, a second end of the third condensing tube being communicated with a first end of the liquid outlet tube;
a compressor, an outlet of which is communicated with the first end of the liquid inlet tube;
a throttling device, an inlet of which is communicated with the second end of the liquid outlet tube;
an evaporator, an inlet of which is communicated with the outlet of the throttling device, and an outlet of which is communicated with the inlet of the compressor.

10. The heat pump water heater of claim 9, wherein the inner tank is provided with a cold water inlet tube, wherein
a first end of the cold water inlet tube is adapted to be communicated with outside water source, a second end thereof being extended downwardly into the interior of the inner tank close to the bottom of the inner tank.

11. The heat pump water heater of claim 10, further comprising:

a temperature sensor disposed on the inner tank.

12. The heat pump water heater of claim 11, wherein the temperature sensor is disposed at an inner wall or outer wall of the inner tank.

13. The heat pump water heater of claim 11, further comprising:

a blind tube disposed at an outer wall of the inner tank and extended into the interior of the inner tank, wherein the temperature sensor is disposed inside the blind tube.

14. The heat pump water heater of claim 11, wherein the temperature sensor is disposed over the first condensing tube.

15. The heat pump water heater of claim 11, wherein a plurality of through apertures are formed on a part of the cold water inlet tube inside the water tank, with the through apertures being configured substantially toward the temperature sensor.

16. The heat pump water heater of claim 15, wherein the through apertures are disposed at substantially the same level with the temperature sensor.

17. A water tank, comprising:

an inner tank; and a condenser disposed on the inner tank for heating water contained therein, having:

a liquid inlet tube defining a first end and a second end;

a liquid outlet tube defining a first end and a second end;

a first condensing tube wound around an outer wall of an upper part of the inner tank, a first end of the first condensing tube being communicated with the second end of the liquid inlet tube;

a second condensing tube wound around an outer wall of the lower part of the inner tank, a first end of the second condensing tube being communicated with the second end of the liquid inlet tube; and a third condensing tube wound around an outer wall of a bottom part of the inner tank beneath the lower part, a first end of the third condensing tube being communicated with second ends of the first and second condensing tubes respectively, a second end of the third condensing tube being communicated with a first end of the liquid outlet tube;

wherein the first condensing tube is wound upwardly around the inner tank from the second end of the liquid inlet tube.

* * * * *